United States Patent [19]

Schumacher et al.

[11] 3,998,087

[45] Dec. 21, 1976

[54] PRESS SLIDE WITH EXTENDABLE AND RETRACTABLE TOOL SUPPORT

[75] Inventors: John P. Schumacher; William F. Hollenbeck, both of Louisville, Ohio

[73] Assignee: Gulf & Western Manufacturing Company, Southfield, Mich.

[22] Filed: Oct. 30, 1975

[21] Appl. No.: 627,224

[52] U.S. Cl. ..... 72/349; 72/405; 72/453.01

[51] Int. Cl.[2] ..... B21D 24/00

[58] Field of Search ..... 72/453, 429, 348, 405, 72/349; 100/269

[56] References Cited

UNITED STATES PATENTS

| | | | |
|---|---|---|---|
| 3,064,507 | 11/1962 | Strugala | 72/453 |
| 3,085,530 | 4/1963 | Williamson | 72/453 |
| 3,143,007 | 8/1964 | Thompson | 72/453 |
| 3,780,560 | 12/1973 | Zimmer | 72/453 |
| 3,862,564 | 1/1975 | Blase | 72/405 |

*Primary Examiner*—C.W. Lanham
*Assistant Examiner*—Gene P. Crosby
*Attorney, Agent, or Firm*—Meyer, Tilberry & Body

[57] ABSTRACT

The slide of a multiple station metalworking press is provided with a plurality of punches mounted on the slide for movement therewith and including one punch which is extendable and retractable relative to the slide in the direction of slide movement. The extendable and retractable punch is hydraulically actuated during reciprocating movement of the slide and is so actuated by a fluid pumping arrangement responsive to slide movement. As the slide moves downwardly toward the press bed the one punch is extended relative to the slide. Similarly, during movement of the slide away from the bed the one punch is retracted relative to the slide. Accordingly, the extendable and retractable punch has a stroke longer than that of the slide by the amount of extension of the punch relative to the slide.

13 Claims, 6 Drawing Figures

PRESS SLIDE WITH EXTENDABLE AND RETRACTABLE TOOL SUPPORT

This invention relates to the art of presses and, more particularly, to a tool supporting arrangement for a metalworking press.

The present invention finds particular utility in connection with a multiple station press for forming large artillery projectiles and will be described in detail herein with regard thereto. As will become apparent hereinafter, however, the invention is readily applicable to the production of articles other than projectiles and for use in general with metalworking presses wherein it is desirable to achieve a tool stroke longer than that provided by the stroke of the press slide.

The production of large artillery projectiles, such as 105 millimeter projectiles, requires several forging operations beginning with a steel billet. These forging operations are sequentially performed on the billet or workpiece and are commonly referred to as sizing, cabbaging, piercing and drawing. Generally, the sizing, cabbaging and piercing operations can be performed in one press having corresponding stations to which the workpiece is sequentially transferred between strokes of the press slide. Heretofore, however, the drawing operation has required the use of a second press in that the stroke required for the drawing punch exceeded the stroke capability of the first press. The press performing the sizing, cabbaging and piercing operations can be either a mechanically or hydraulically driven press, and the drawing press has always been hydraulically driven because of the long workstroke required in connection with the drawing operation.

The requirement of two presses and the necessity of providing equipment for transferring workpieces therebetween increases both the amount and cost of equipment. Additionally, the required floor space for the equipment is increased as is the personnel required to operate the equipment. Moreover, the hydraulic draw press is a very costly item in that it requires a large power unit due to the long draw stroke and fast draw speed required to maintain a desired production line output capability. The foregoing equipment requirements and the disadvantages thereof are not only applicable to the manufacture of large artillery projectiles but also to the manufacture of articles such as, for example, high pressure cylinders, gas bottles, and the like wherein a drawing operation requires a longer tool stroke than that provided by the slide of the press in which preliminary forming operations are performed.

The present invention advantageously enables a tool mounted on a press slide, such as a drawing punch, to be extended relative to the slide so as to have an effective stroke longer than the slide stroke. Accordingly, in connection with the production of large projectiles, for example, the sizing, cabbaging and piercing operations and additionally the drawing operation can be performed in a single press, thus avoiding the necessity for a separate press to perform the drawing operation. Thus, the amount of equipment, floor space and operating personnel required is reduced, whereby equipment and production costs are reduced and efficiency of production is increased.

More particularly in accordance with the present invention, the tool is extendable and retractable relative to the slide. Such extension and retraction is interrelated with movement of the slide through its stroke such that movement of the slide from its top dead center to its bottom dead center position results in displacement of the tool from its retracted to its extended position, and such that the return movement of the slide results in displacement of the tool from the extended to the retracted position relative to the slide. Preferably, extension and retraction of the tool relative to the slide is achieved hydraulically by means of a pumping arrangement actuated by movement of the slide relative to the press frame. Such hydraulic actuation of the tool enables the incorporation of overload protection in the hydraulic circuit responsive to an increase in fluid pressure in the circuit resulting from an overload on the tool during the drawing operation being performed thereby.

An outstanding object of the present invention is the provision of the reciprocable slide of a metalworking press with a tool support which is extendable and retractable relative to the slide in the direction of slide movement.

Another object is the provision of a metalworking press of the foregoing character in which extension and retraction of the tool support relative to the slide is concurrent respectively with the advance and return movements of the slide relative to the press bed.

Still another object is the provision of a metalworking press of the foregoing character in which the tool support is actuated in response to movement of the slide through its stroke.

A further object is the provision of a metalworking press of the foregoing character in which the tool support is hydraulically actuated by a fluid displacing assembly driven by the slide.

Still a further object is the provision of a multiple station metalworking press which enables two or more metalworking operations to be performed during each stroke of the slide and at least one of which operations is a drawing operation requiring a tool stroke greater than the stroke of the slide.

Yet a further object is the provision of a multiple station metalworking press having a slide supporting at least one metalworking tool for the one tool to have a stroke corresponding to the slide stroke and supporting at least one additional metalworking tool which is extendable and retractable relative to the slide so as to have a stroke longer than the slide stroke.

Yet another object is to increase production efficiency and reduce equipment, floor space and personnel requirements in conjunction with the press production of a metal article requiring at least one preliminary forming operation followed by a drawing operation.

The foregoing objects, and others, will in part be obvious and in part pointed out more fully hereinafter in conjunction with the written description of a preferred embodiment of the invention illustrated in the accompanying drawings in which.

Figure 1:
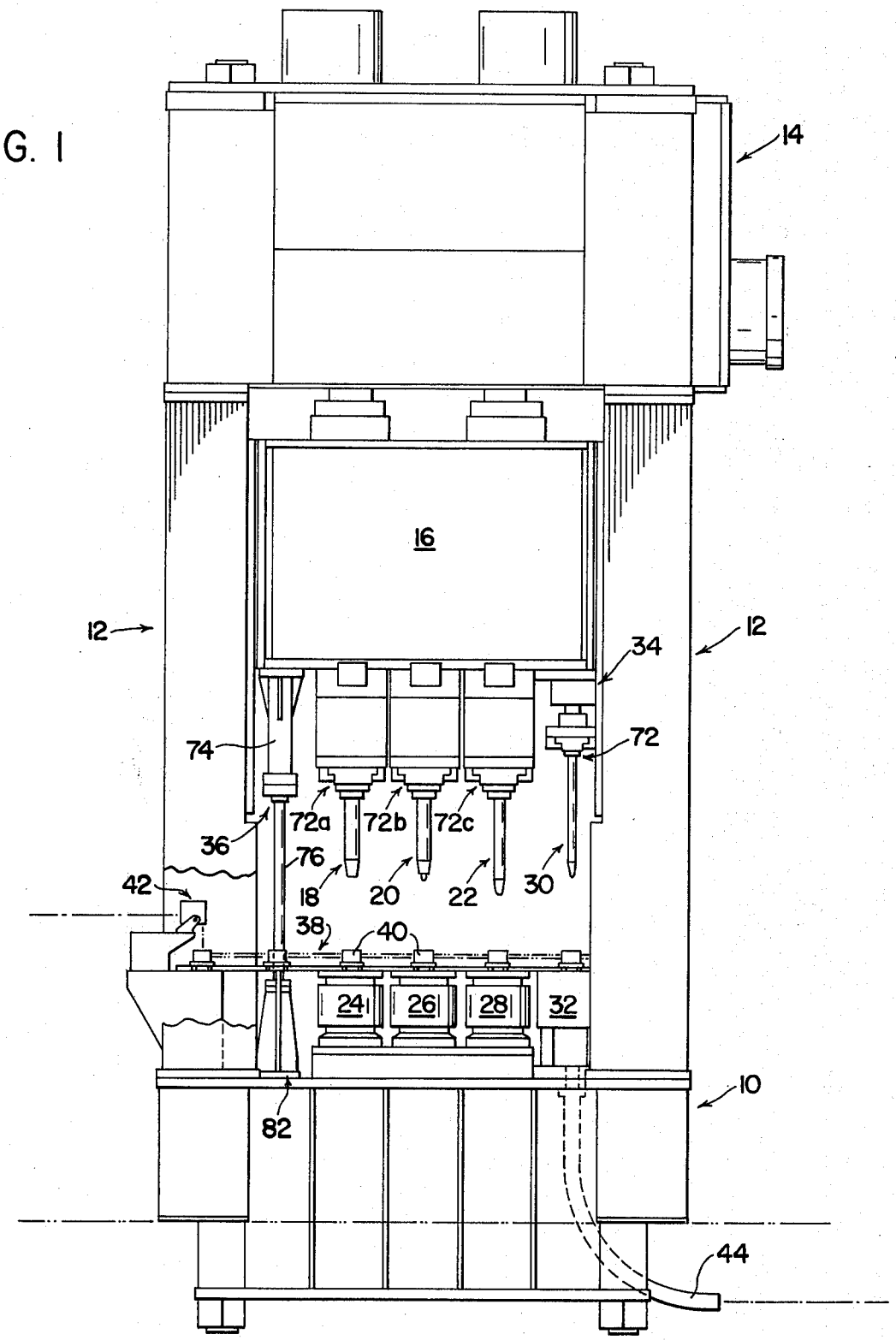
FIG. 1 is a front elevation view of a multiple station metalworking press including an extendable and retractable drawing punch tool mounted on the press slide in accordance with the present invention.

Referring now in greater detail to the drawings wherein the showings are for the purpose of illustrating a preferred embodiment of the invention only and not for the purpose of limiting the invention, FIG. 1 of the drawing illustrates a multiple station metalworking press for producing artillery projectiles from a steel billet. The press is comprised of a frame including a bed 10, uprights 12 and a top portion 14. In a well known manner, the press slide 16 is supported by the frame for reciprocating movement vertically through a slide stroke. As is well known, the slide advances from top dead center toward bottom dead center in the direction toward bed 10, and the distance between the top and bottom dead center positions defines the length of the slide stroke. Slide 16 can be mechanically or hydraulically driven and, in the present embodiment, is driven by a mechanical press drive train. The components of such a drive train and the interrelationships therebetween and with the slide are well known to those skilled in the art and are not important to the understanding of the present invention and, accordingly, are not shown and described in detail.

Slide 16 and bed 10 support a plurality of punches and corresponding die assemblies, respectively, which are cooperable during each stroke of the slide to perform a metalworking operation on a workpiece disposed therebetween. In connection with the production of artillery projectiles, the tool pairs include sizing, cabbaging and piercing punches 18, 20 and 22, respectively, mounted on slide 16, and corresponding sizing, cabbaging and piercing die assemblies 24, 26 and 28 mounted on the press bed beneath and in alignment with the punches. Punches 18, 20 and 22 are mounted on slide 16 for movement therewith in the direction toward and away from bed 10 and against movement relative to the slide in the latter direction. Accordingly, punches 18, 20 and 22 have strokes corresponding to that of the slide.

In accordance with the present invention, the tool pairs further include an extendable and retractable draw punch 30 mounted on slide 16 and a corresponding drawing die assembly 32 mounted therebeneath on the press bed. Punch 30 is mounted on slide 16 for reciprocating movement therewith and, additionally, is reciprocable relative to slide 16 in the direction toward and away from bed 10 and between retracted and extended positions relative to the slide. More particularly, punch 30 is extended relative to slide 16 during movement of the slide toward bed 10 and is retracted during the return movement of the slide. To achieve these displacements of the punch, slide 16 is provided with a hydraulically actuated punch reciprocating assembly 34, and a hydraulic fluid displacing assembly 36 is associated with slide 16 and the press frame to actuate assembly 34 in response to reciprocation of slide 16. In this respect, as will become apparent hereinafter, assemblies 34 and 36 are in fluid flow communication with one another in a manner such that fluid displacing assembly 36 operates during downward movement of slide 16 to pump fluid to punch actuating assembly 34 to displace punch 30 from the retracted toward the extended position relative to the slide. Similarly, during upward movement of the slide assembly 36 operates to pump fluid to assembly 34 so as to displace punch 30 from the extended to the retracted position relative to the slide.

Figure 2:
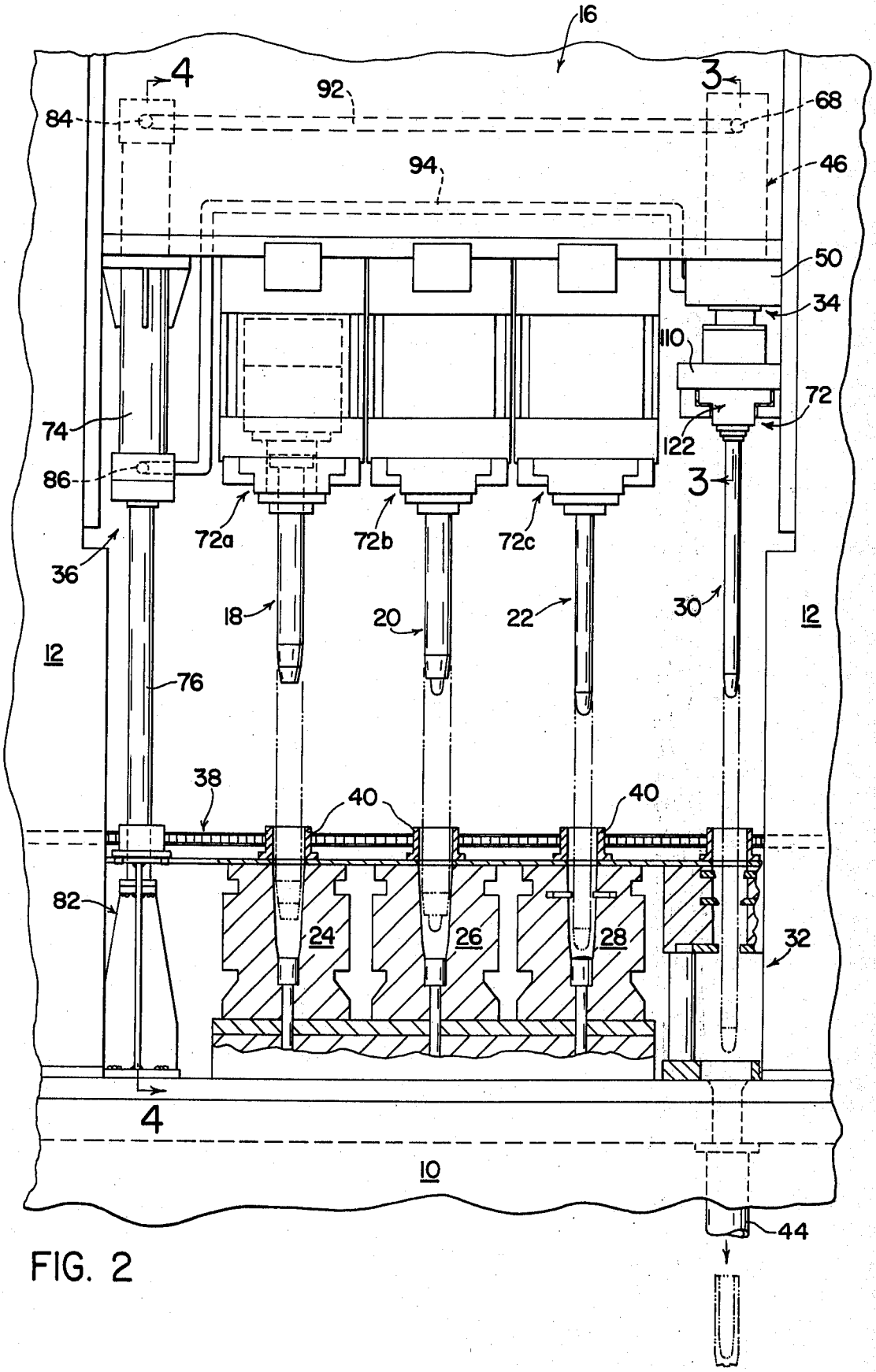
FIG. 2 is an enlarged front elevation view showing the work stations of the press.

In conjunction with the production of artillery projectiles in the press structure thus far described, the press is provided with a suitable workpiece conveying mechanism 38 including workpiece buckets 40. A workpiece or billet to be formed is introduced into a bucket 40 by suitable feed device 42, and the conveyor is actuated to advance buckets 40 sequentially from one punch station to the next in coordination with reciprocating movement of slide 16. The forming operation performed at each station is illustrated in FIG. 2, and it will be appreciated that the die assemblies 24, 26 and 28 include suitable ejector arrangements for displacing a formed workpiece upwardly to the level of the corresponding bucket 40 for displacement to the next punch station. The structures and operations of such ejector arrangements are well known and do not form a part of the present invention.

At the drawing station, the workpiece is elongated and thinned during displacement through drawing die assembly 32 by punch 30 and the drawn projectile is discharged from the press through a suitable chute or the like 44. As described hereinabove, punch 30 is extended relative to slide 16 during downward movement of the slide and thus has a stroke longer than the slide stroke. It will be appreciated that this longer stroke enables the drawing operation to be performed simultaneously with the sizing, cabbaging and piercing operations which are performed by punches 18, 20 and 22 during movement through corresponding strokes equal to the slide stroke.

Figure 3:
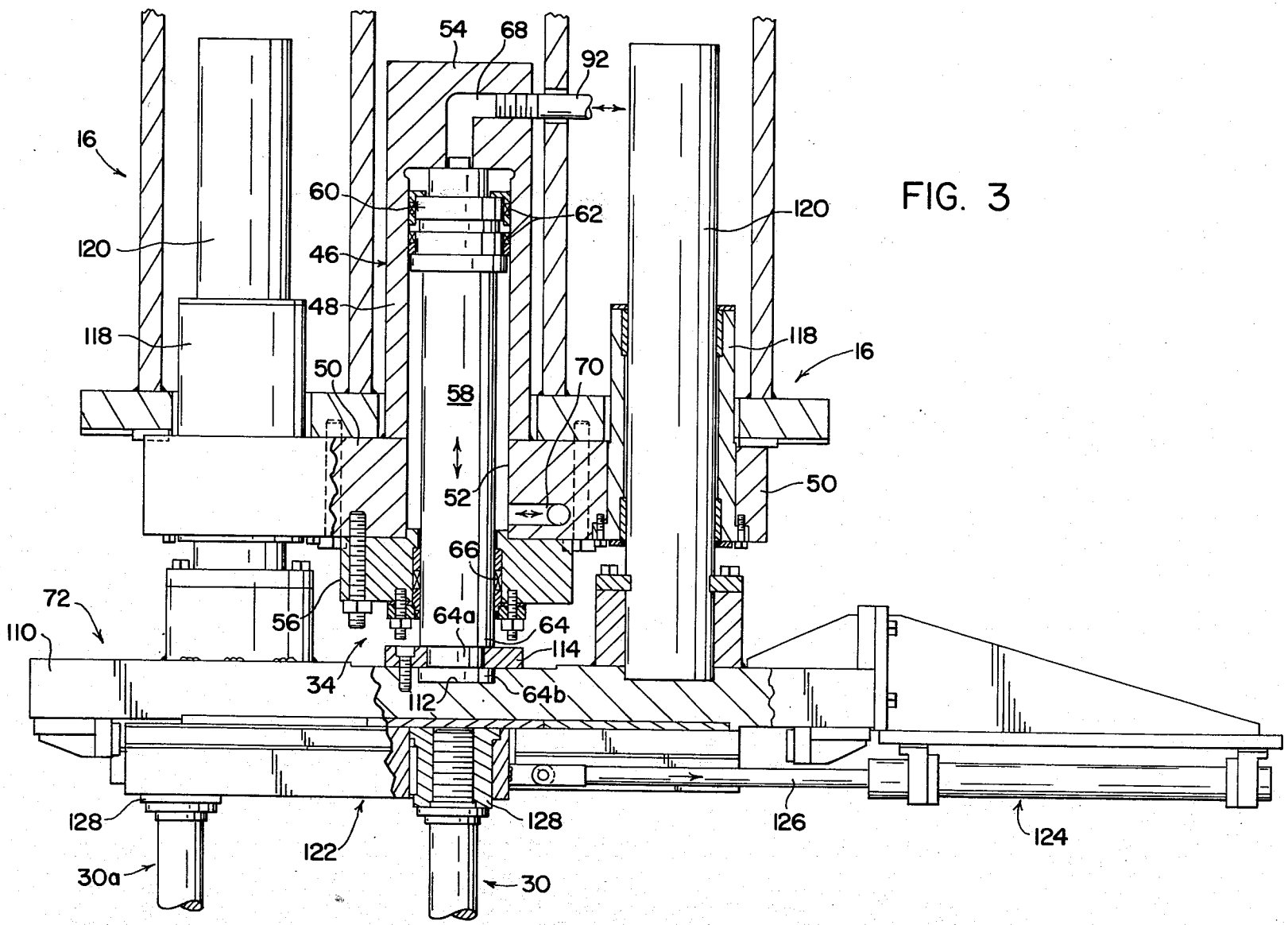
FIG. 3 is a cross-sectional elevation view taken along line 3—3 in FIG. 2 and showing the extendable and retractable punch tool actuator.

As best seen in FIG. 3 of the drawing, punch actuating assembly 34 is in the form of a double acting piston and cylinder mechanism including a cylinder 46. Cylinder 46 is comprised of a cylindrical housing 48 welded or otherwise attached to a support plate 50 by which the cylinder is mounted on press slide 16 for reciprocating movement therewith. Plate 50 has an opening 52 therethrough which is cooperable with the inner surface of housing portion 48 to define a cylinder chamber having an inner end defined by wall 54 of housing portion 48. The outer end of the cylinder chamber is defined by an apertured plate 56 bolted or otherwise suitably attached to support plate 50.

Punch actuating assembly 34 further includes a piston comprising a ram 58 coaxial with cylinder 46 and having an inner end 60 provided with suitable packing 62 to define a piston head in the cylinder chamber. Outer tool supporting end 64 of ram 58 is interconnected with punch 30 in the manner set forth more fully hereinafter. End 64 of the ram extends through the aperture in plate 56, and the latter aperture is provided with suitable packing 66 to sealingly engage the ram. Inner end 60 of the ram is reciprocable in the cylinder chamber between a fluid flow portion 68 in end wall 54 and a fluid flow port 70 in support plate 50. Accordingly, it will be appreciated that hydraulic fluid introduced into the cylinder chamber through port 68 displaces ram 58 downwardly relative to slide 16, and that hydraulic fluid introduced into the cylinder chamber through portion 70 displaces ram 58 upwardly relative to the slide. Punch 30 is coaxial with ram 58 and can be attached to outer end 64 of the ram in any suitable manner so as to be reciprocable therewith. In the particular embodiment shown, punch 30 is mounted on ram 58 through a tool shuttle mechanism 72 described more fully hereinafter.

Figure 4:
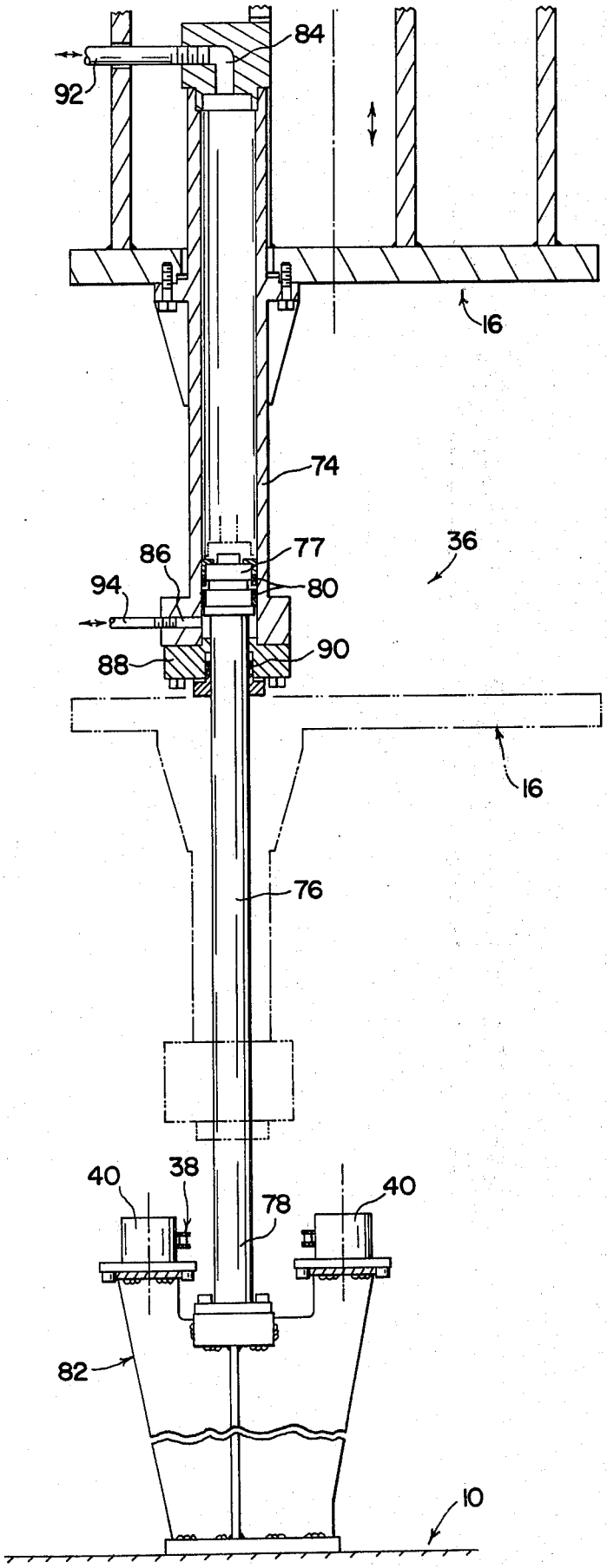
FIG. 4 is a cross-sectional elevation view taken along line 4—4 in FIG. 2 and showing the hydraulic fluid displacing assembly for operating the extendable and retractable punch tool actuator.

As mentioned hereinabove, hydraulic fluid displacing assembly 36 is operable to pump fluid to punch actuating assembly 34 to displace punch 30 between retracted and extended positions relative to slide 16. As best seen in FIG. 4 of the drawing, fluid displacing assembly 36 is in the form of a double acting piston and cylinder arrangement including a cylinder 74 mounted on slide 16 for movement therewith. Assembly 36 further includes a piston comprising a ram 76 coaxial with cylinder 74 and having an upper end 77 disposed in cylinder 74 and a lower end 78 attached to bed 10 of the press frame. More particularly, upper end 77 of the ram is provided with suitable packing 80 to define a piston head within cylinder 74, and lower end 78 is bolted or otherwise secured to a supporting base 82 which is in turn welded or otherwise secured to the press bed. The upper end of cylinder 74 is provided with fluid flow port 84, and the lower end of the cylinder is provided with a fluid flow port 86. Ram 76 extends through an apertured plate 88 attached to the lower end of cylinder 74, and the aperture through the latter plate is provided with suitable packing 90 which sealingly engages ram 76.

Since cylinder 74 is mounted on slide 16 for movement therewith it will be appreciated that the cylinder has a stroke corresponding to that of the slide. Further, since ram 76 is fixed relative to the press bed, it will be appreciated that the ram has a length relative to bed 10 for the piston head to be in the cylinder when the slide is in its uppermost position and that cylinder 74 has a length to permit displacement of the cylinder relative to the piston head a distance corresponding to the slide stroke. As more fully described hereinafter, movement of slide 16 downwardly relative to the press bed results in hydraulic fluid in cylinder 74 being displaced therefrom through fluid port 84, and upward or return movement of slide 16 results in fluid in the cylinder being displaced therefrom through fluid port 86.

As seen in FIG. 2, fluid port 84 of cylinder 74 of fluid displacing assembly 36 is connected by a fluid flow line 92 with fluid port 68 of cylinder 46 of tool actuating assembly 34. Further, fluid port 86 of cylinder 74 is connected by fluid flow line 94 with fluid port 70 of cylinder 46. When slide 16 is in its uppermost position with respect to the press bed, ram 58 of tool actuating assembly 34 is in the retracted position relative to cylinder 46, as shown in FIG. 3, and ram 76 of fluid displacing assembly 36 is in its extended position relative to cylinder 74, as shown in FIG. 4. In these positions of the components, hydraulic fluid fills the cylinder space below the piston head of ram 58 and above the piston head of ram 76. Accordingly, downward movement of slide 16 displaces cylinder 74 relative to ram 76 to pump fluid through port 84 and line 92 into port 68 of cylinder 46, thus to displace ram 58 and punch 30 from the retracted toward the extended position during such downward movement of the slide. During this movement, the fluid below the piston head of ram 58 is displaced through fluid port 70 and line 94 into port 86 beneath the piston head of ram 76.

When slide 16 reaches the bottom of its stroke, punch 30 is fully extended relative to the slide and hydraulic fluid fills the cylinder space above the piston head of ram 58 and below the piston head of ram 76. Accordingly, return movement of slide 16 displaces cylinder 74 upwardly relative to ram 76, whereby hydraulic fluid is pumped through port 86 and line 94 into port 70 of cylinder 46 to displace ram 58 and thus punch 30 from the extended toward the retracted position. During this movement, the hydraulic fluid above the piston head of ram 58 is displaced through line 92 into the cylinder space above the piston head of ram 76. When slide 16 reaches the top of its stroke the component parts are again in the positions illustrated in FIGS. 3 and 4.

It will be appreciated from the foregoing description that punch 30 moves with the slide and relative thereto in the direction of slide movement so that the punch has a stroke greater than that of the slide. This enables a deep drawing operation to be performed concurrently with the forming operations performed by punches 18, 20 and 22 which have a stroke corresponding to that of slide 16. The force on slide 16 through punch 30 during the drawing operation is advantageously counterbalanced by locating fluid displacing assembly 36 on the opposite side of the slide from punch actuating assembly 34. In the embodiment shown, the vertical center line of the press is through cabbaging punch 20 and, preferably the axes of assemblies 34 and 36 are symmetric with respect to the press center line.

Figure 5:
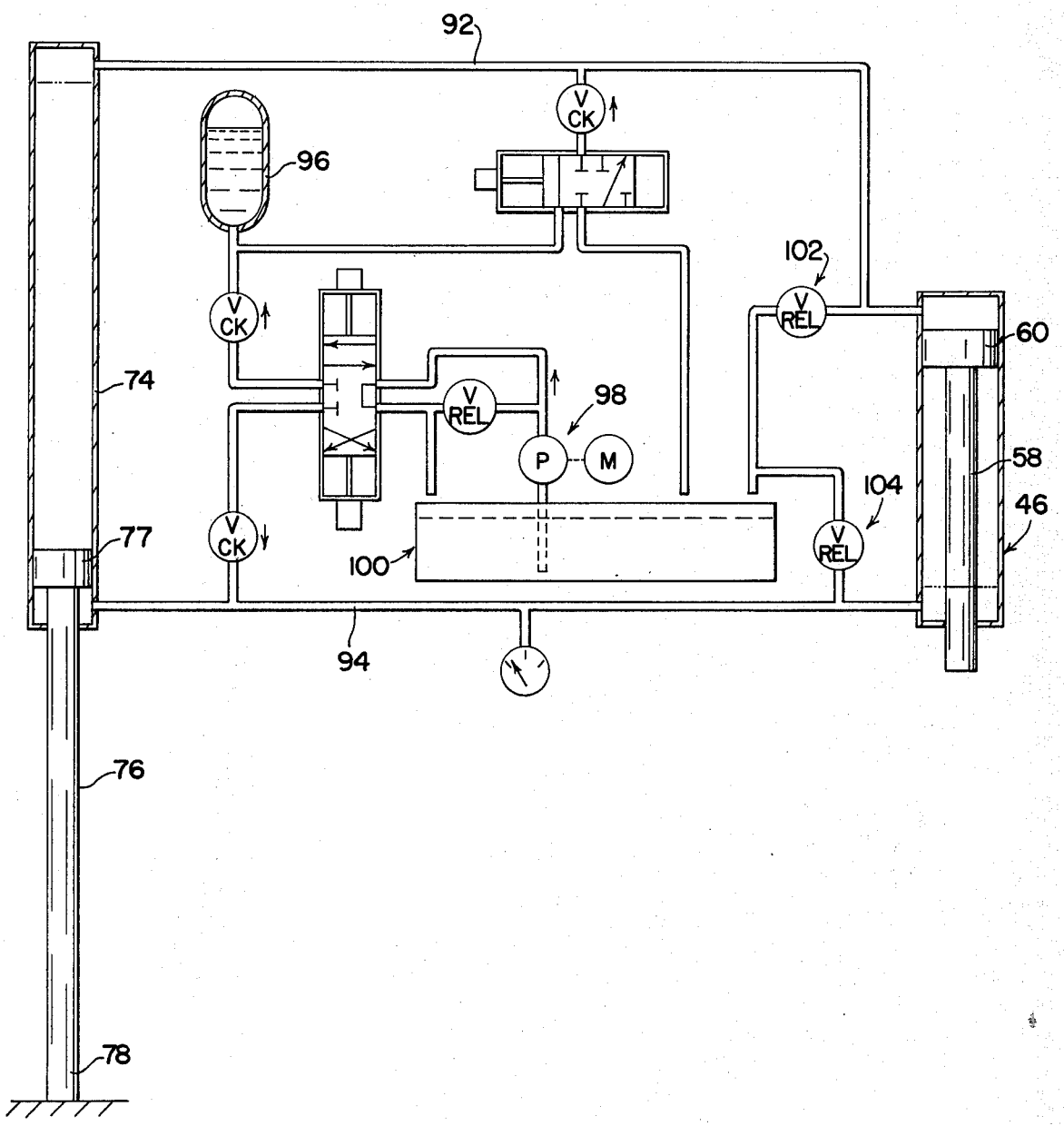
FIG. 5 is a schematic illustration of the hydraulic circuit for the fluid displacing assembly and the punch tool actuator; and, FIG. 6 is a graph showing the relative displacements of the slide and extendable and retractable punch tool during a cycle of press operation.

FIG. 5 schematically illustrates the hydraulic circuit for achieving the foregoing punch actuation in response to slide displacement. In FIG. 5, like numerals are employed to represent component parts of the tool actuating and fluid displacing assemblies described hereinabove in connection with FIGS. 3 and 4 of the drawing. In addition to flow lines 92 and 94 referred to hereinabove, the hydraulic system includes an accumulator 96 for system fluid under pressure, and a low pressure motorized pump 98 for delivering hydraulic fluid from a source 100 to the system. Flow line 92 is provided with a pressure responsive relief valve 102 leading to source 100, and flow line 94 is provided with a pressure relief valve 104 leading to source 100.

Relief valves 102 and 104 advantageously provide overload protection for the press and the extendable and retractable punch during both the advance and return portions of slide movement relative to the press bed. In this respect, should punch 30 counter resistance during downward movement of slide 16 and the resulting extension of the punch relative to the slide, cylinder 74 will continue to move with the slide and thus pump fluid into the upper end of cylinder 46. The resistance to movement of the punch with and relative to the slide creates an excess pressure in flow line 92 and, in response to each excess pressure, relief valve 102 opens to permit fluid flow from line 92 to source 100. This relief of pressure in line 92 and cylinder 46 allows relative movement between cylinder 46 and ram 58 in the direction of retraction of the ram during advancement of slide 16. Likewise, should punch 30 encounter resistance during return movement of the slide tending to restrain retracting movement of the ram, cylinder 74 moves with the slide and thus continues to pump fluid through line 94 into the cylinder space beneath the piston head of ram 58. The resistance to movement of ram 58 therefore increases the fluid pressure in line 94 and when this pressure exceeds a predetermined level valve 104 opens to permit fluid flow from line 94 to source 100. Accordingly, the pressure in line 94 and cylinder 46 is relieved permitting relative movement between cylinder 46 and ram 58 in the direction of extension of ram 58 during return movement of the slide. It will be appreciated of course that relief valves 102 and 104 can be employed to actuate suitable controls to stop the press or provide some other appropriate safety function in response to the existence of such an overload condition.

In connection with the production of large steel projectiles by a multiple stage punch forming process, the punch tools are heated both by frictional engagement with the workpiece and by heat transfer from the billet or workpiece which is initially hot. Accordingly, it becomes desirable to cool the punch tools and to lubricate the tools between successive engagements thereof with the workpiece. Shuttle mechanisms similar to shuttle mechanism 72 referred to hereinabove with regard to the mounting of punch 30 on ram 58 of actuating assembly 34 facilitate such cooling and lubrication of the punches. This will become apparent from the following description of shuttle assembly 72 shown in FIG. 3 of the drawing.

Referring now to FIG. 3, shuttle mechanism 72 includes a support plate 110 attached to outer end 64 of ram 58. In this respect, ram end 64 is provided with an annular recess 64*a* providing a head 64*b* which is received in a recess 112 in plate 110. A retaining ring 114 is suitably attached to plate 110 such as by bolts to interconnect the plate and ram 58. Accordingly, plate 110 is reciprocable with ram 58 relative to slide 16. In order to prevent relative rotation between plate 110 and cylinder 46, support plate 50 is provided with guide sleeves 118 and plate 110 is provided with guide rods 120 slidably received in sleeves 118.

Shuttle mechanism 72 further includes a shutter slide assembly 122 suitably supported by plate 110 for reciprocating movement transverse to the axis of ram 58. A double acting hydraulic piston and cylinder unit 124 is mounted on plate 110 and includes piston rod 126 attached to shuttle slide assembly 122 to reciprocate the latter. It will be appreciated that a suitable source of hydraulic fluid and suitable controls, not shown, are provided to reciprocate the shuttle slide in the manner set forth hereinafter. A pair of tool mounting sleeves 128 are mounted on shuttle slide assembly 122 for movement therewith, and reciprocating movement of shuttle slide 122 alternately positions sleeves 128 beneath ram 58 in coaxial relationship therewith. In the present embodiment, each sleeve 128 is internally threaded to receive the upper end of a corresponding punch tool 30 and 30*a*. Punches 30 and 30*a* are identical and the upper ends thereof are externally threaded for interconnection with sleeves 128. Further, ram 58 is coaxial with die ring assembly 32 on the press bed, whereby in FIG. 3 the punch 30 positioned beneath ram 58 is cooperable with the drawing ring assembly during reciprocation of press slide 16.

Further in connection with the punch cooling and lubrication function, a pair of open top liquid reservoirs or dip tanks, not shown, are provided on bed 10 at the drawing station and on diametrically opposite sides of drawing die assmmbly 32. With regard to the position of shuttle slide 122 in FIG. 3, one of the dip tanks is beneath punch 30*a* and the other is positioned to the right of punch 30 a distance corresponding to the location of punch 30 upon shifting shuttle slide 122 to the right to position punch 30*a* beneath ram 58. During operation of the press, with punches 30 and 30*a* positioned as shown in FIG. 3, punch 30 is axially aligned with drawing ring assembly 32 and cooperates therewith during downward movement of slide 16 to perform work on a workpiece therebetween. At the same time, punch 30*a* enters the dip tank therebeneath and is cooled and lubricated by liquid therein. Following upward movement of the press slide, shuttle slide 122 is actuated to laterally shift punches 30 and 30*a* to the right, whereby punch 30*a* is positioned in alignment with drawing ring assembly 32 and punch 30 is aligned with the second dip tank at the drawing station. Accordingly, the succeeding downward movement of slide 16 provides for work to be performed by punch 30*a* and for punch 30 to be cooled and lubricated.

While shuttle mechanism 72 is only shown and described in detail in connection with draw punches 30 and 30*a*, a pair of each of the punches 18, 20 and 22 are also mounted on slide 16 by means of functionally similar shuttle mechanisms, designated generally by numerals 72*a*, 72*b* and 72*c* in FIGS. 1 and 2 of the drawing. Accordingly, two identical punches are provided at each of the work stations, one behind the other as viewed in FIGS. 1 and 2. Further, it will be appreciated that each work station is provided with a pair of dip tanks which are located and function in the manner described above with regard to the drawing station. While such shuttling of a pair of tools at each station of the press for the foregoing purpose is desirable in connection with the production of large projectiles, it will be readily apparent that a shuttle mechanism is not necessary in connection with the structure and operation of tool actuating assembly 34 in axially displacing punch 30 between retracted and extended positions relative to the slide 16.

Figure 6:
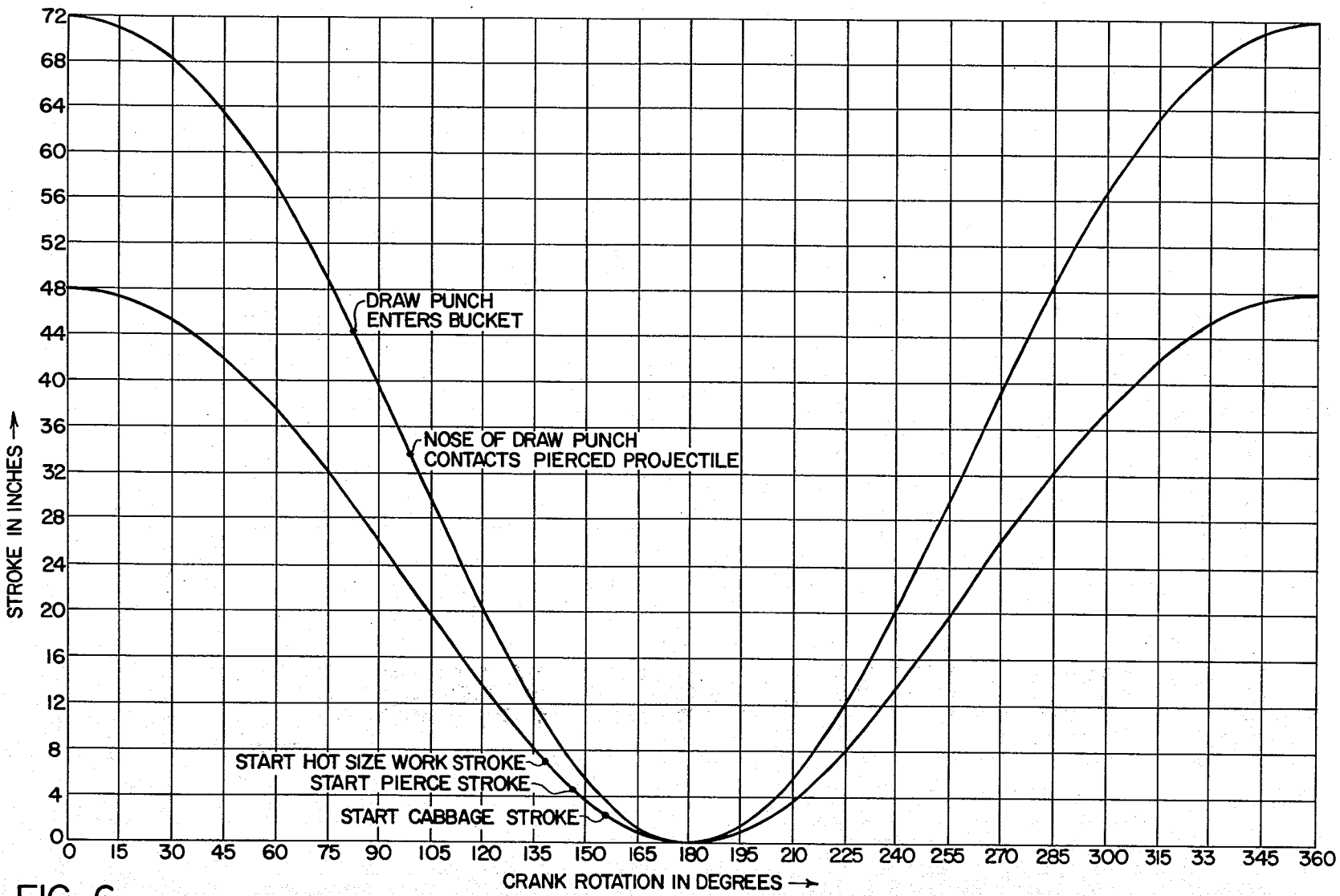

In connection with the embodiment of the invention herein disclosed, the press is mechanically driven and includes a slide crank, each revolution of which corresponds to one cycle of slide displacement between the top dead center and bottom dead center positions. The slide has a stroke of forty-eight inches and, accordingly, the sizing, cabbaging and piercing punches each have a forty-eight inch stroke. Likewise, cylinder 74 of fluid displacing assembly 36 has a forty-eight inch stroke. Cylinder 46 of punch actuating assembly 34 has a cross-sectional area approximately twice the cross-sectional area of cylinder 74 of fluid displacing assembly 36, whereby drawing punch 30 has a stroke of approximately twenty-four inches relative to press slide 16 and a total stroke of approximately seventy-two inches during movement of the press slide through its stroke. The hydraulic pumping arrangement for extending and retracting the drawing punch relative to the press slide provides for the advance and return movements of the press slide and drawing punch to be simultaneous with one another and in the same direction with respect to the press bed. This relationship is shown in the graph of FIG. 6 illustrating the displacement curves for the slide and punch during one complete revolution of the slide crank.

While the present invention has been described in connection with the production of projectiles in a multiple station punch press, it will be appreciated from the foregoing description that the extendable and retractable tool arrangement is adaptable to other press structures and to the production of articles other than projectiles and wherein a tool stroke is required which is longer than that provided by the press slide. It will be further appreciated that arrangements other than the preferred hydraulic fluid displacing arrangement herein described can be employed to achieve extension and retraction of the tool relative to the slide. In this respect, for example, other hydraulic fluid pumping arrangements can be provided as well as mechanical arrangements to achieve the desired extending and retracting movements of the tool relative to the slide. In connection with the hydraulic pumping arrangement disclosed, it will be understood that different proportional relationships between the cross-sectional areas of cylinders 46 and 74 can be employed to obtain different lengths for the stroke of the extendable and retractable tool. It will be further appreciated that more than one extendable and retractable tool support can be employed with a given slide, and that such additional tool supports can provide for a corresponding tool to have a stroke equal to or different from that of the one tool. Many embodiments of the invention will be suggested and obvious from the description of the preferred embodiment, and many modifications of the preferred arrangement herein illustrated and described can be made without departing from the principles of the present invention. Accordingly, it is to be distinctly understood that the foregoing descriptive matter is to be interpreted merely as illustrative of the present invention and not as a limitation.

What is claimed is:

1. A metalworking press comprising, frame means including a bed, a slide supported by said frame means for reciprocating movement relative to said bed through a slide stroke, hydraulic cylinder means on said slide and movable therewith, tool support means including reciprocable ram means, said ram means including piston means in said cylinder means and reciprocable relative thereto to displace said ram means relative to said slide and through a second stroke, means to reciprocate said slide, and hydraulic pump means connected to said cylinder means and driven by said slide to displace said ram means through said second stroke during movement of said slide through said slide stroke, said pump means including relatively reciprocable piston and cylinder members mounted one on said slide and the other on said frame means, and the cross-sectional area of said cylinder means being greater than the cross-sectional area of said cylinder member.

2. The press according to claim 1, wherein said cylinder member is mounted on said slide for movement therewith and said piston member is mounted on said frame means.

3. The press according to claim 1, wherein said slide stroke and second stroke are simultaneous, said slide stroke has a length, and said second stroke has a length less than said slide stroke length.

4. The press according to claim 1, and at least one tool support mounted on said slide for movement therewith through said slide stroke and against movement relative to said slide in the direction of said slide stroke.

5. A metalworking press comprising, frame means including a bed, a slide supported by said frame means for reciprocating movement relative to said bed through a slide stroke, means to reciprocate said slide, a first hydraulic cylinder mounted on said slide for movement therewith, first ram means having opposite ends, one of said opposite ends being fixed with respect to said bed and the other of said opposite ends including first piston means in said first cylinder, a second hydraulic cylinder mounted on said slide for movement therewith, second ram means having inner and outer ends, said inner end including second piston means in said second cylinder and said outer end providing tool support means, and hydraulic fluid circuit means including hydraulic fluid lines connecting said first and second cylinders on opposite sides of the corresponding piston means so that reciprocating movement of said slide displaces said first cylinder relative to said first ram means to extend and retract said outer end of said second ram means relative to said slide.

6. The press according to claim 5, wherein said slide has a center line in the direction of said slide stroke and said first and second cylinders are mounted on said slide on opposite sides of said center line and generally symmetrically with respect thereto.

7. The press according to claim 5, wherein said hydraulic circuit means includes fluid pressure responsive relief valve means in said hydraulic fluid lines connecting said first and second cylinders.

8. The press according to claim 5, and at least one tool support mounted on said slide for movement therewith through said slide stroke and against movement relative to said slide in the direction of said slide stroke.

9. The press according to claim 5, wherein said slide stroke has a length, and said first and second cylinders have different cross-sectional areas, whereby said outer end of said second ram means is extended relative to said slide a distance proportional to said length.

10. The press according to claim 9, wherein said second cylinder has a cross-sectional area about twice the cross-sectional area of said first cylinder.

11. A multiple station metalworking press comprising, frame means including a bed, a slide supported by said frame means for reciprocating movement relative to said bed through a slide stroke, a first punch mounted on said slide for movement therewith through a first punch stroke corresponding to said slide stroke and having a work stroke portion, a first die on said bed in a first location and in alignment with said first punch, a drawing punch, means mounting said drawing punch on said slide for movement therewith and for reciprocating movement relative thereto between extended and retracted positions to provide a drawing punch stroke longer than said slide stroke and having a work stroke portion longer than said work stroke portion of said first punch stroke, a drawing die on said bed at a second location in alignment with said drawing punch, said first and second locations being laterally spaced apart with respect to the direction of slide movement, said first and drawing punch strokes being in the same direction, means to reciprocate said slide through said slide stroke and thus said first punch through said first punch stroke, and means actuated by said slide during reciprocating movement of said slide to reciprocate said drawing punch relative to said slide for said first and drawing punch strokes to be simultaneous.

12. The press according to claim 11, wherein said mounting means for said drawing punch includes cylinder means mounted on said slide for movement therewith and hydraulically extendable and retractable piston means in said cylinder means and connected to said drawing punch, and said means to reciprocate said drawing punch includes hydraulic pump means actuated by said slide during reciprocating movement thereof to extend and retract said piston means.

13. The press according to claim 12, wherein said pump means includes second piston means and second cylinder means mounted one on said slide and the other on said frame means for relative displacement in response to reciprocating movement of said slide.

* * * * *

Disclaimer 3,998,087.—*John P. Schumacher* and *William F. Hollenbeck*, Louisville, Ohio. PRESS SLIDE WITH EXTENDABLE AND RETRACTABLE TOOL SUPPORT. Patent dated Dec. 21, 1976. Disclaimer filed Aug. 5, 1977, by the assignee, *Gulf & Western Manufacturing Company*.

Hereby enters this disclaimer to claim 11 of said patent.

[*Official Gazette September 20, 1977.*]